US005424764A

United States Patent [19]

Yamaguchi et al.

[11] Patent Number: 5,424,764

[45] Date of Patent: Jun. 13, 1995

[54] THERMAL RECORDING APPARATUS FOR RECORDING AND ERASING AN IMAGE ON AND FROM A RECORDING MEDIUM

[75] Inventors: Takashi Yamaguchi; Tadayoshi Ohno; Shinichi Itoh, all of Kawasaki, Japan

[73] Assignee: Kabushiki Kaisha Toshiba, Kawasaki, Japan

[21] Appl. No.: 110,921

[22] Filed: Aug. 24, 1993

[30] Foreign Application Priority Data

Aug. 24, 1992 [JP] Japan ..... 4-223855

[51] Int. Cl.[6] ..... B41M 5/26; B41M 5/28; B41J 2/315; B41J 2/325

[52] U.S. Cl. ..... 347/179; 346/135.1; 359/43; 359/44

[58] Field of Search ..... 346/76 L, 1.1, 76 R, 346/76 PH, 108, 135.1; 400/120; 359/43, 44

[56] References Cited

U.S. PATENT DOCUMENTS 4,695,528 9/1987 Dabisch et al. ..... 430/290
4,965,591 10/1990 Kurabayashi et al. ..... 346/108

FOREIGN PATENT DOCUMENTS 55-154198 12/1980 Japan .
2-3876 1/1990 Japan .
2-19568 2/1990 Japan .

OTHER PUBLICATIONS

Hotta, Y., et al, "Reversible Thermosensitive Material and Printing Characteristics", Proceedings of 4th Japanese Symposium on Non-impact Printing Technologies Symposium, 3-2, pp. 57-60 (1987).

Hino, Y., et al, "Rewritable Leuco-thermal Recording Medium", Japan Hardcopy '90, The Annual Conference of Japan Hardcopy for the Society of Electrophotography of Japan, NIP-2, pp. 147-150.

*Primary Examiner*—Huan H. Tran
*Attorney, Agent, or Firm*—Cushman Darby & Cushman

[57] ABSTRACT

A printing system for recording and erasing a visible image on/from a recording medium being changed between transparent and non-transparent states depending on a heating temperature. A thermal recording device which includes a section for electrically energizing a heating element using a driving pulse train is used to head the recording medium, thereby changing its state. The first driving pulse train has a plurality of pulses of a first duty factor in one dot formation period for recording each non-transparent dot on the recording medium. A second driving pulse train for electrically energizing the heating elements has pulses of a second duty factor which are different from the first duty factor, the number of second pulses being substantially the same as that of the first driving pulse train in order to record the transparent dot on the recording medium or to erase the non-transparent dot from the recording medium.

9 Claims, 6 Drawing Sheets

THERMAL RECORDING APPARATUS FOR RECORDING AND ERASING AN IMAGE ON AND FROM A RECORDING MEDIUM

BACKGROUND OF THE INVENTION

1. Field of the Invention

The present invention relates to a printing system for recording or erasing a visible image on/from a recording medium, where the state of the recording medium is changed to a cloudy state or a transparent state by applying heat energy thereto. The visible image can be repeatedly recorded or erased using a thermal recording device such as a thermal head.

2. Description of the Related Art

In the conventional hard copy, an image is formed on a recording medium such as paper by using an image forming material such as ink or toner provided from an external unit. Alternatively, a recording layer may be formed on a base material such as thermal recording paper, and a visible image may be formed on the recording layer. In other words, a permanent image was recorded.

However, in recent years, in accordance with the spread of the formation of various networks, facsimiles, and copy machines, the consumption of these recording mediums is rapidly increased, there occurs a problem of natural destruction such as deforestation and a social problem such as refuse disposal or rubbish. In order to deal with these problems, the reduction of the consumption of the recording medium such as recycle of the recording paper has been required. Along the lines, a recording medium, which can record/erase repeatedly, has recently been developed.

As a recording medium having such a characteristic, for example, Published Unexamined Japanese Patent Application No. 55-154198 discloses a recording medium, which can reversibly change between the transparent and cloudy states according to the temperature of the recording material.

In this recording medium, for example, if the temperature is increased to a first threshold temperature from a normal cloudy state, the recording medium is changed to a transparent state from the cloudy state, where the transparent state is maintained after the temperature returns to the normal temperature. If the temperature exceeds the first threshold temperature and is increased to a second threshold temperature, the recording medium is in a cloudy state, where the cloudy state can be maintained even after the temperature is returned to the normal temperature. This change can be repeatedly reproduced.

The discussion on the deterioration of resolution occurred when an image is repeatedly recorded on and erased from such a recording medium is reported in e.g., Proceedings of 4th Japanese Symposium on Non-impact Printing Technologies Symposium, 3-2, p 57 (1987).

Moreover, as disclosed in Published Unexamined Japanese Utility Model Application No. 2-19568, there has been proposed a display changing apparatus for displaying and erasing using a display medium having a heat reversible recording material. This apparatus comprises erasing means for thermally erasing characters on the display medium and printing means for thermally printing the characters. As a specific example, this document describes the structure in which the heat reversible display on the display medium for a floppy disk cartridge is erased by a heater head (erasing means), and displayed or written by a moving thermal head (printing means).

Furthermore, Published Unexamined Japanese Utility Model Application No. 2-3876 discloses an apparatus for recording/erasing a display on/from a data recording card having a heat reversible recording layer by use of a heat roller (erasing means) and a thermal head (printing means).

Moreover, in Japan Hardcopy '90, NIP-2, p 147 (1990), there has been reported a recording material using leuco dye, as a coloring source, which can provide a reversible tone change by based on the thermal energy.

As mentioned above, the printing system using the recording medium, which can repeatedly record and erase, can solve the problems of the conventional printing system. Particularly, a recording medium, which is formed of a compound recording material layer of low/high polymers repeatedly showing the cloudy and transparent states according to the above-mentioned different temperature process, is an excellent material, for recording and erasing using the thermal head frequently employed in the conventional thermal recording means.

Conventionally, when a visible image is recorded or erased to/from the recording medium repeatedly showing the cloudy and transparent states by the above-mentioned different temperature process using the thermal head as thermal recording means, the recording or erasing is performed by voltage-amplitude-modulating or pulse-number-modulating a driving pulse for electrically driving a heating resistance member (heating element) of the thermal head. In such a conventional apparatus, duty factor of the driving pulse at the time of recording and erasing is the same. However, according to the conventional printing system using such a recording medium, the relationship between the recording temperature and the erasing temperature is:

recording temperature (or cloud temperature) > erasing temperature (or transparency temperature).

Therefore, there was a problem in that the temperature control range for erasing was extremely small and recording or erasing of the stable visible image was not able to be performed.

SUMMARY OF THE INVENTION

An object of the present invention is to provide a printing system which can record or erase a stable visible image, and miniaturize and simplify the apparatus.

According to one aspect of the present invention, there is provided a printing system for recording and erasing a visible image on/from a recording medium. This printing system has a recording layer which is changed to be transparent by heating at a first temperature range and to be non-transparent heating at a second temperature range by a thermal head having a plurality of heating elements, is used for heating. The printing system comprises generating circuit for generating a first pulse train having a plurality of pulses of a first duty factor in one dot formation period in order to record each non-transparent dot forming the visible image on the recording medium, a circuit for electrically conducting the heating elements by using the first pulse train, a generating circuit for generating a second pulse train including pulses of a second duty factor smaller than the first duty factor, where the number of the pulses is substantially equivalent to that of the first driving pulse train in order to record each transparent space dot on the recording medium, and a circuit for electrically conducting the heating elements by use of the second pulse train.

Further, according to another aspect of the present invention, there is provided a method for forming a visible image by heating a recording medium showing first and second states which are dependent upon a heating process using a thermal recording device. That method comprising the steps of electrically conducting the thermal recording means using a first driving pulse train having a plurality of pulses of a first duty factor in one dot formation period in order to record each dot set in the first state forming the visible image on the recording medium; and electrically conducting the thermal recording means 10 using a second pulse train including pulses of a second duty factor different from the first duty factor, and the number of the pulses being substantially the same as that of the first driving pulse train in order to record one dot set in the second state on the recording medium.

Therefore, the same heating elements are electrically energized by use of the pulse train having the same number of pulses for recording and erasing, thereby the visible image can be recorded and erased, and the apparatus can be miniaturized and simplified.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

FIG. 5A shows a basic pulse train, FIG. 5B is recording data, FIG. 5C is a recording pulse train, FIG. 5D is erasing data, and FIG. 5E is an erasing pulse train;

FIG. 6A shows a recording pulse, and FIG. 6B is a temperature change of the heating element in the thermal head at this time;

FIG. 7A shows an erasing pulse, and FIG. 7B is a temperature change of the heating element in the thermal head at this time;

FIG. 12A shows one example of the weighting table, and FIG. 12B shows image data corresponding to the weighting table.

DETAILED DESCRIPTION OF THE PREFERRED EMBODIMENTS

Embodiments of the present invention will be explained with reference to the drawings.

Figure 1:
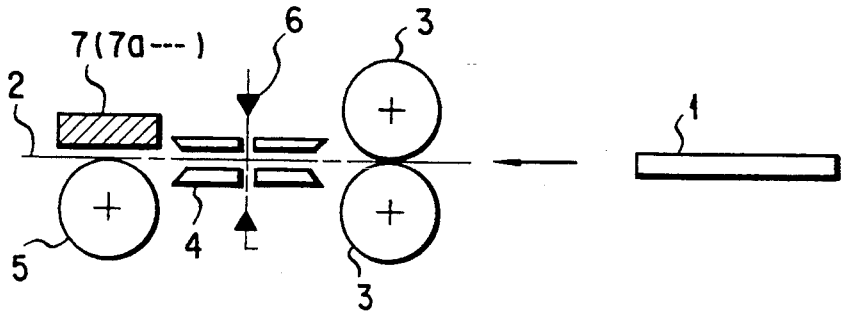
FIG. 1 shows one embodiment of a recording apparatus using a printing system of the present invention.

FIG. 1 shows one embodiment of a recording apparatus using a printing system according to the present invention. A recording medium 1 is transferred to a transfer passage 2 through a pair of transfer rollers 3, a transfer guide 4, and a platen roller 5. A detector 6 is provided in the vicinity of the transfer guide 4 of the transfer passage 2. The detector 6 detects the top end of the recording medium transferred on the transfer passage 2. The detector 6 comprises a pair of a light emitting element and a light receiving element, and is a well-known detector. The pair of the transfer rollers are driven to be rotated by a motor (not shown). A thermal head 7, which comprises a plurality of heating elements *7a*, is provided at a position opposite to the platen roller 5.

Figure 2:
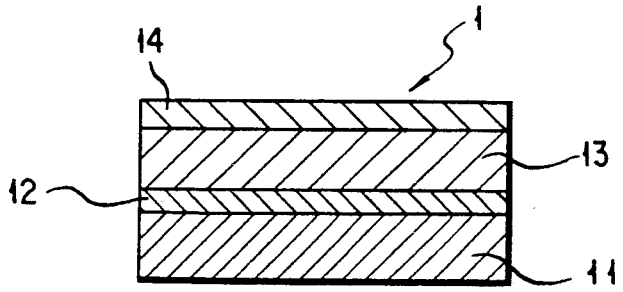
FIG. 2 shows one example of a cross sectional view of a recording medium.

The recording medium 1 uses a composite membrane recording material having low and high polymers as a recording layer. The recording medium 1 is changed to a transparent state or a cloudy state by the heating temperature. This change is reversibly performed, and the transparent state and the cloudy state can be repeatedly reproduced by controlling the heating temperature. FIG. 2 is a cross sectional view of the recording medium 1. More specifically, the recording medium 1 is formed of a color layer 12, which is colored block on one surface of a base material 11, a recording layer 13 reversibly showing the transparent state and the cloudy state, and a protection layer 14, which are sequentially laminated.

Figure 3:
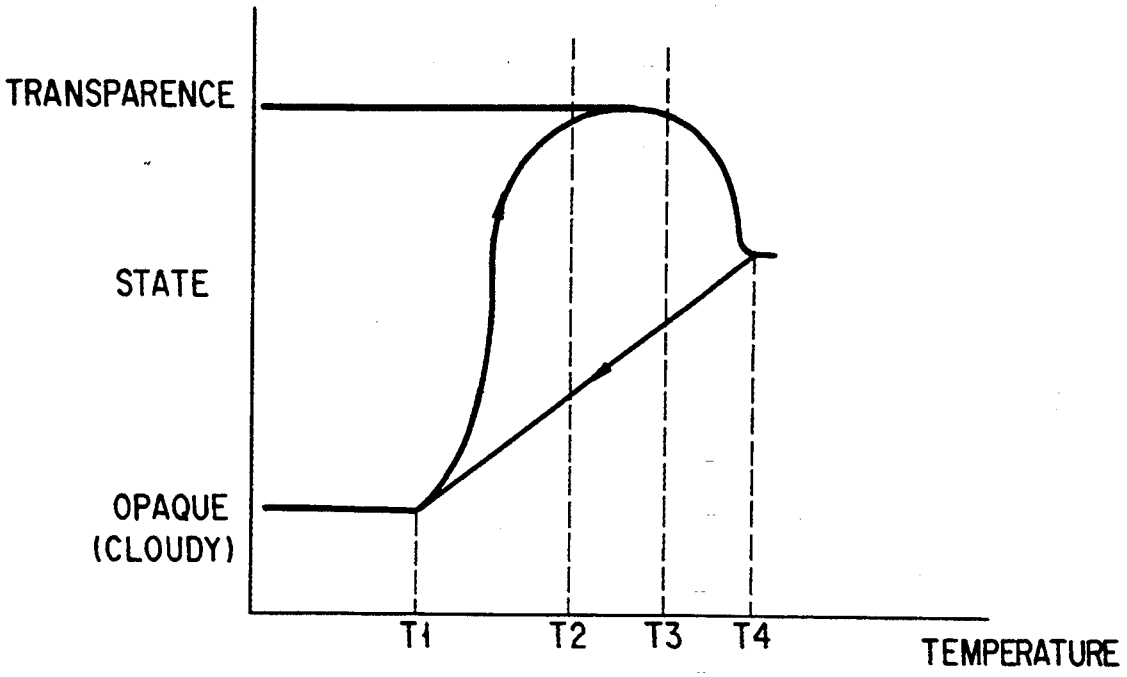
FIG. 3 shows one example of a temperature characteristic of the recording medium.

FIG. 3 shows a temperature characteristic of the recording medium 1. If the recording medium 1 is heated from a normal temperature T1, which is the cloudy state, to temperature T2, the recording medium 1 is changed to the transparent state. Thereafter, even if the recording medium 1 is cooled to the normal temperature T1, the transparent state is maintained. Then, if the recording medium 1 is heated from the normal temperature T1, which is the transparency state, to temperature T4 through temperatures T2 and T3 and cooled to T1 again, the recording medium 1 is changed to the cloudy state, and the cloudy state is maintained. As mentioned above, this change can be repeatedly reproduced.

Figure 4:
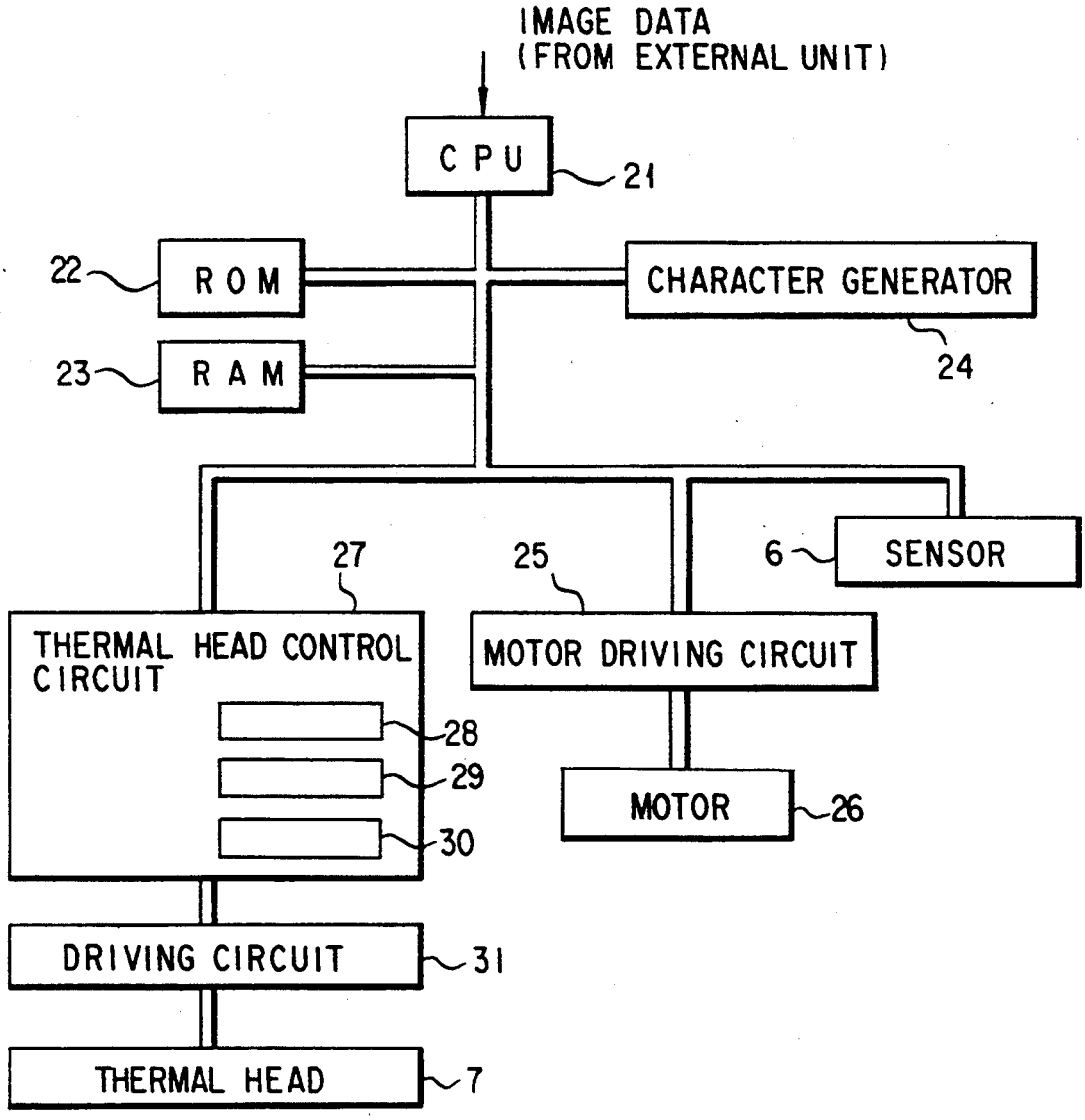
FIG. 4 is a block diagram schematically showing a circuit structure of the recording apparatus using the printing system of the present invention.

FIG. 4 is a block diagram showing an electric circuit of the recording apparatus of the present invention. A ROM (read only memory) 22, a RAM (random access memory) 23, a character generator 24, a thermal head control circuit 27, a motor driving circuit 25, and the detector 6 are connected to a CPU (central processing unit) 21.

The CPU 21 inputs code data as image data from an external unit (not shown). The CPU 21 outputs bit data corresponding to code data to a thermal head 7, so that heating elements *7a* . . . corresponding to bit data are heated. The ROM 22 stores a control program of CPU 21. The RAM 23 is used to temporarily store various types of data such as bit data from the character generator 24. The character generator 24 stores font data corresponding to various types of the code data, that is, bit data, and outputs bit data corresponding to code data.

After the top end of the recording medium 1 is detected by the detector 6, the thermal head control circuit 27 applies an electrical pulse intermittently to each thermal element *7a* of the thermal head 7 at a predetermined timing. In other words, the thermal head control circuit 27 controls the temperature of each of the heating elements *7a* so as to record a visible image to the recording layer 13 of the recording medium 1 or to erase (transparentizing) an unnecessary visible image of the recording layer 13. The motor driving circuit 25 drives a motor 26 for rotating the pair of transferring rollers 3. A basic pulse train generator. 28, (means for generating a pulse signal) a recording pulse train generator 29, (first means) and an erasing pulse train generator 30 (second means) are included in the thermal head control circuit 27. These pulse trains will be explained in detail later. The pulse train generated by the recording pulse train generator 29 or the erasing pulse train generator 30 is current-amplified by a thermal head driving circuit 31. The thermal head driving circuit 31 electrically energizes the thermal head 7 (thermal recording means) by use of the pulse train.

Figures 5A, 5B, 5C, 5D, 5E:
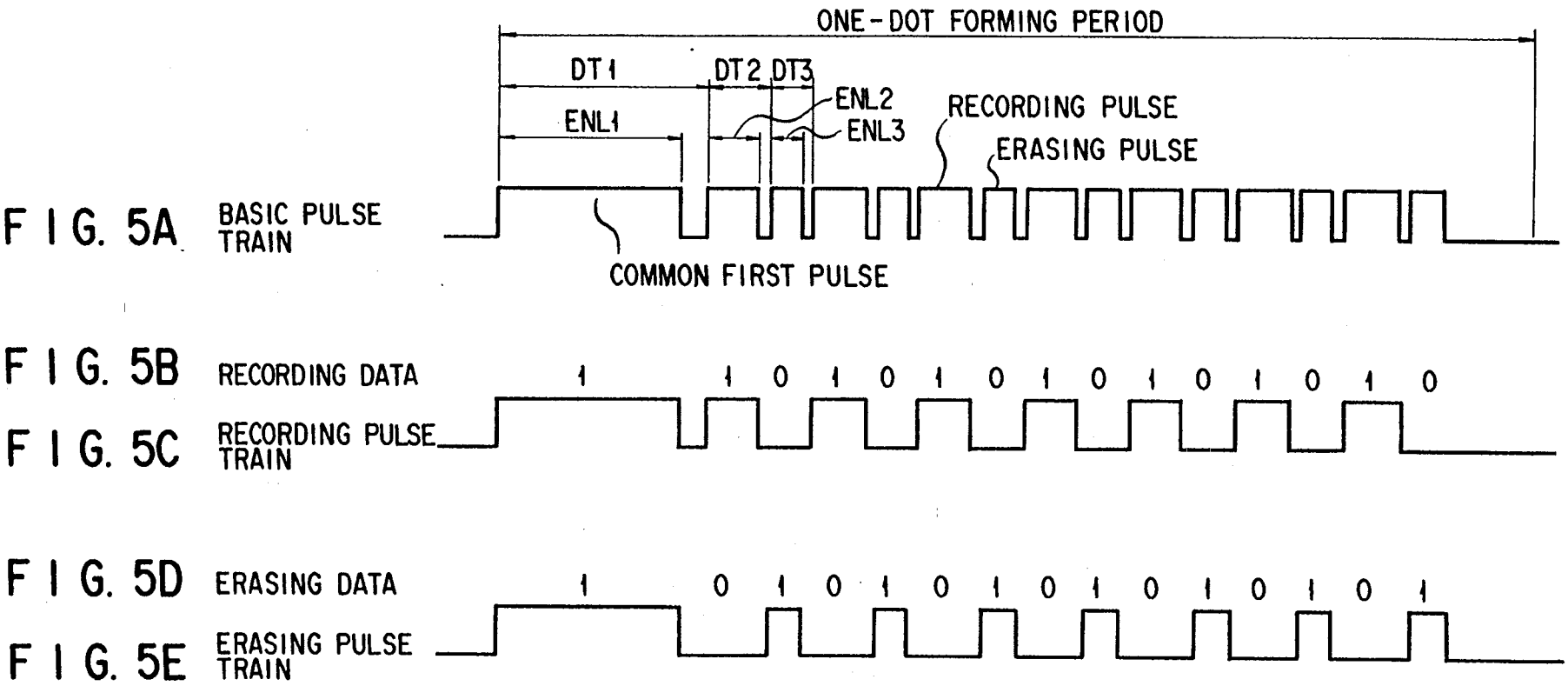
FIGS. 5A to 5E show the driving pulse trains to each heating element in a thermal head by the printing system according to one embodiment of the present invention.

FIGS. 5A to 5E show various signals processed by the thermal head control circuit 27 and the thermal head 7; FIG. 5A is a basic pulse train (pulse signal) of the thermal head; FIG. 5B is data for recording one dot; FIG. 5C is a pulse train for energizing the heating element *7a* when recording, that is, a recording pulse train (recording pulse signal or first driving pulse train) which is obtained based on the signal of FIG. 5A; FIG. 5D is data for erasing one dot; and FIG. 5E is a pulse train for energizing the heating element when erasing, that is, an erasing pulse train (erasing pulse signal or second driving pulse train) which is obtained based on the signal of FIG. 5A.

According to the printing system of the present invention, as shown in FIG. 5A, the driving pulse train of the thermal head is formed by use of three types of unit pulses ENL1, ENL2 and ENL3 each having a different width (electrically energizing time). The first pulse ENL1 (first period) is a common unit pulse, which is the widest of all, and is first used at the time of both recording and erasing. Following the first pulse (ENL1), a different pulse is used depending on whether it is recording or erasing. As shown in FIG. 5C pulses ENL2 (second period) are used at the time of recording. As shown in FIG. 5E, pulses ENL3 (third period) whose width is shorter than ENL2, are used at the time of erasing.

In a case where recording is performed, recording data "110101010101010" is inputted to the thermal head control circuit 27 through CPU 21, so that the common unit pulse ENL1 shown in FIG. 5C and a plurality of recording unit pulses ENL2 are outputted to a predetermined heating element *7a* from the thermal head control circuit 27 through the thermal head driving circuit 31. Also, in a case where erasing is performed, erasing data "101010101010101" shown in FIG. 5D is inputted to the thermal head control circuit 27, so that the common first pulse ENL1 shown in FIG. 5E and a plurality of erasing unit pulses ENL3 are outputted to the heating element *7a*.

According to the recording method of the present invention, in one dot forming period, which is a minimum recording unit of a visual image to be recorded, the heating element *7a* of the thermal head is energized by the driving pulse train, which is formed of the plurality of pulses, and heated. Then, the recording medium, which shows the state transition as shown in FIG. 3 comes in contact with the heating element *7a*, so that the visible image is recorded.

In the conventional thermal recording medium, e.g., photosensitive recording paper or thermal transfer recording ribbon, if the recording medium is simply heated at more than one threshold value showing the state transition of coloring, softening, melting and sublimation, the visible image can be recorded. In contrast, the feature of the recording medium used in the present invention, which cannot be found in tile conventional thermal recording medium, lies in the points that two threshold value temperatures of recording and erasing and that ternary control of the temperature is needed.

According to the a printing system of the present invention, a constant voltage driving pulse train is applied to each heating element *7a* of the thermal head in one dot formation period, the width of the first pulse of the pulse train is the widest, and a duty factor of pulses following the first pulse are different in recording and erasing.

Figure 6A:
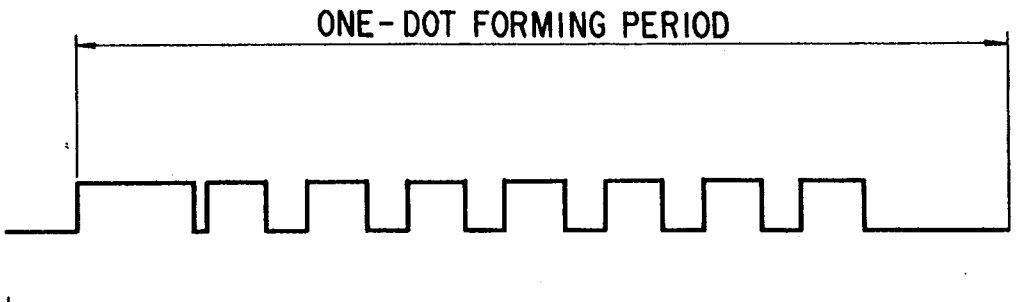
FIGS. 6A and 6B show a recording state using the printing system of the embodiment of the present invention.
Figure 6B:
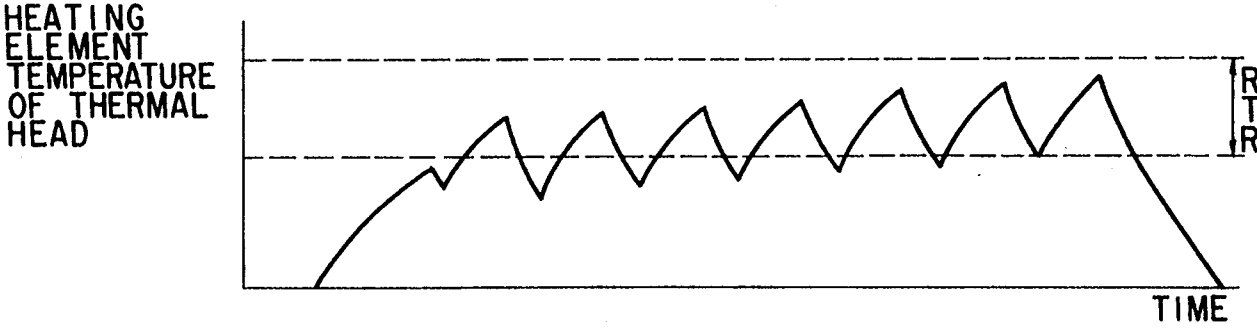
Figure 7A:
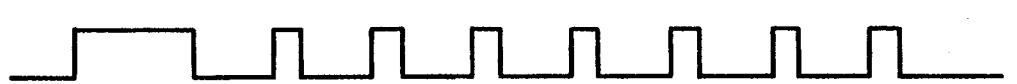
FIGS. 7A and 7B show an erasing state using the printing system of the embodiment of the present invention.
Figure 7B:
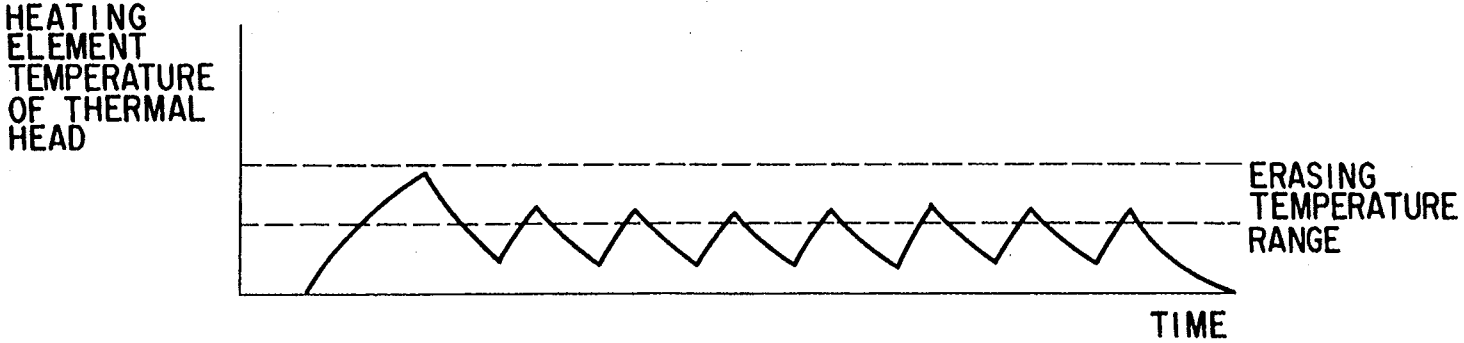

For example, each constant of elements in the present invention will be shown as follows:

Average Resistance Value of Heating Element: 600Ω
the Number of Recording Pulses In One Dot Formation Period = the Number of Erasing Pulses: 8
One Dot Formation Period: 3.125 ms
DT1: 1.25 ms
ENL1: 1.0 ms
DT2: 0.182 ms
ENL2: 0.181 ms
DT3: 0.078 ms
ENL3: 0.077 ms
Applied voltage: 10 V FIGS. 6 and 7 explain the recording and erasing operations by use of the driving pulse trains shown in FIGS. 5A; 5C and 5E in detail. FIG. 6A shows a driving pulse at the time of recording, that is, a recording pulse train; FIG. 6B is a heating temperature characteristic of the heating element *7a* of the thermal head at that time; FIG. 7A is a driving pulse at the time of erasing, that is, an erasing pulse train; and FIG. 7B is a heating temperature characteristic of the heating element *7a* of the thermal head at that time.

As mentioned above, if the plurality of driving pulses are sent to the heating element *7a*, an envelope of the temperature of the heating element smoothly increases based on the balance between the heat accumulation and heating in the vicinity of the heating element. It therefore reaches the objective temperature range, and is maintained in the temperature range for a long period of time.

According to the printing system of the present invention, the duty factor of the thermal head driving pulse: pulse width/period = ENL/(DT2 + DT3), is changed depending on the recording operation and the erasing operation, respectively. Thereby, the balance between the heating and the radiation of the heating element, that is, the balance between the heating and the radiation of the recording medium is changed at the time of recording and erasing, and the maximum reaching temperature of the recording medium is controlled.

Moreover, as explained in the above embodiment of the present invention, the driving pulses, which have the different width at time of recording and erasing and which have the same number, are used, thereby heating time which is required for one dot recording, and heating time which is required for one dot erasing, become the same as each other. Moreover, it is possible to maintain the recording medium to be at the recording temperature or the erasing temperature for substantially the same and relatively long period of time.

According to the printing system of the present invention, phases of the pulses following the first pulse ENL1 for driving each heating element 7*a* of the thermal head, differ at the time of recording and erasing. Since the phase of the recording pulse ENL2 and that of the erasing pulse ENL3 are important, this will be explained with reference to FIGS. 8 and 9.

Figure 8:
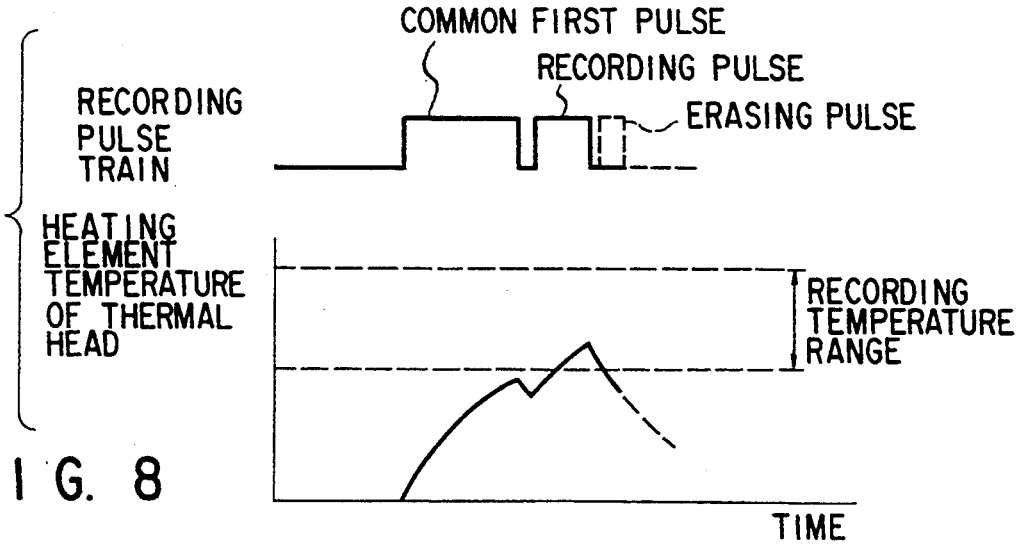
FIG. 8 shows the order of the driving pulse driving the thermal head.
Figure 9:
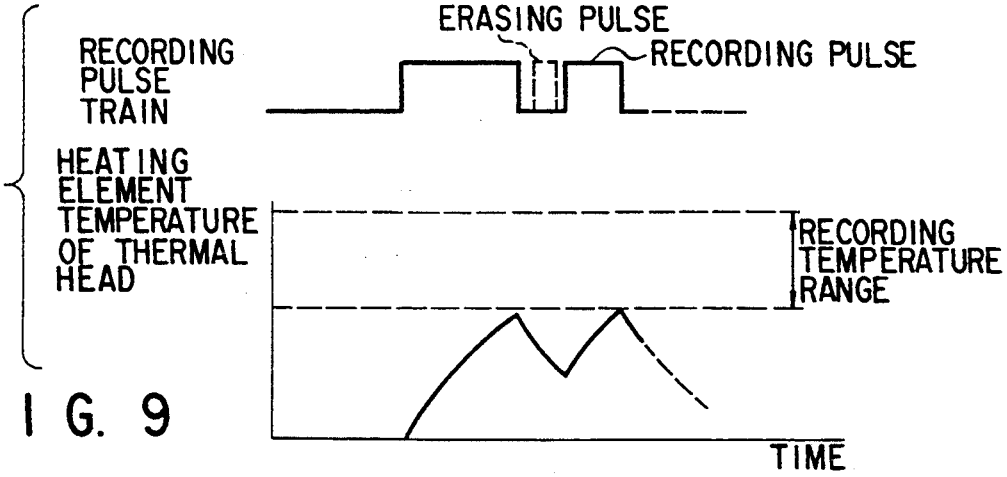
FIG. 9 shows the other order of the driving pulse driving the thermal head.

FIG. 8 shows first two driving pulses at the times of recording and erasing respectively, according to the a printing system of the present invention. The recording pulse is positioned next to the first pulse, and then the erasing pulse is positioned next to the recording pulse. Thereafter, similarly, the recording pulses 10 and the erasing pulses are sequentially generated at the time of recording and erasing respectively. These pulses are generated by the basic pulse train generator 28 of FIG. 4 and separated by the recording pulse train generator 29 or the erasing pulse train generator 30, and outputted to the thermal head driving circuit 31. Conversely, FIG. 9 shows the case that the erasing pulse is positioned next to the first pulse, and then the recording pulse is positioned next to the erasing pulse. Thereafter, similarly, the pulse is sequentially generated in the order of the erasing pulse and the recording pulse at the time of the erasing and recording respectively. According to the printing system, as shown in FIG. 8, the temperature of the heating element 7*a* reaches the recording temperature range by the second pulse. However, as shown in FIG. 9, if the order of the driving pulse is conversely set, the temperature of the heating element 7*a* does not reach the recording temperature range even if the second pulse is generated. Due to this, the rise of the recording process becomes late.

Moreover, according to the printing system of the present invention, in the case that erasing is performed, as shown in FIG. 7, the heating element is heated up to the upper limit of the erasing temperature range by the first pulse and kept by the later pulse, so that the erasing temperature is maintained. However, if 10 the order of the driving pulses are conversely set, the heating element is heated too much, and exceeds the erasing temperature range. Furthermore, if the order of the driving pulses are set to be opposite to the case of the present invention as above and the width of the first pulse is shortened in favor of erasing, the rise of the recording process becomes unfavorably later than the case of FIG. 9.

Figure 10:
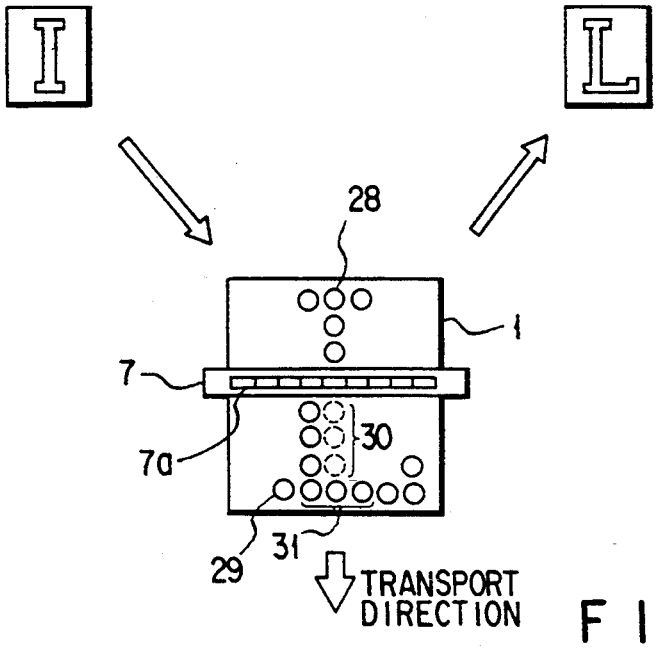
FIG. 10 shows a rewriting outlook using the printing system of the embodiment of the present invention.

FIG. 10 shows the case that a character rewriting is performed by use of the printing system of the present invention. This example shows that a letter "I" is rewritten to a letter "L." In the case that, as shown in the upper left portion of FIG. 10(*a*), the letter "I" is recorded on the recording medium 1 and the letter "L" is written thereon as shown in the upper right portion of FIG. 10(*c*), a process shown in the central portion of FIG. 10(*b*) is performed.

More specifically, the heating element row of the thermal head 7 serving as thermal recording means contacts with the recording medium 1. The direction of the heating element row is arranged to be orthogonal to a transport direction (arrow in the figure) of the recording medium 1. The number of the heating elements 7*a* of the heating element row is provided enough to record the width of the recording medium 1.

In FIG. 10, dots 28 show a part of an image "I", which is already recorded, dots 29 show a part of an image "L", which has been newly recorded, spaces 30 show a part of the image "I", which has been erased, and dots 31 show a part of a dot portion, which has been recorded again. In order to record new dots to the recording medium 1 and to erase unnecessary dots of an image at the same time, the heating element 7*a*, which corresponds to the new dot, is heated to a cloud temperature range of the recording medium 1, and the other heating elements 7*a* may be heated to a transparency temperature range.

The respective heating elements 7*a* of the heating element row are selectively heated to a predetermined temperature range, while the recording medium is transported under the heating element row of the fixed thermal head in the direction of arrow. Thereby, there can be realized a rewrite recording, which is termed over-write recording, for recording the new image 29 and erasing the old image 28 at the same time.

The recording layer 13 of the recording medium 1 used here is transparentized at about 70° to 100° C., and the cloudy state is saturated at about 110° C. Moreover, the upper limit of the heating temperature, which is determined by heat resistance characteristic of the recording layer, was about 160° C. in the recording medium 1.

In the above explanation, the amount of time for electrically energizing the heating element was simply classified to two types in order to set the temperature of the recording medium to the cloud temperature range or the transparency temperature range. However, in reality, in the thermal recording using a thermal head, it has been known that the temperature of the heating element is not always the same because of the heat accumulation of the thermal head, heating process, an environment, etc., even if the electrically energizing time is the same.

In the rewrite recording, it is important to apply heat energy to the recording medium so as to set the temperature of the recording layer to the cloud temperature range or the transparency temperature range regardless of the heat accumulation, heating process, environment. Therefore, in consideration of these factors, imparted energy is controlled, so that the temperature of the recording layer can be more correctly increased to the object temperature.

The following will specifically explain the control of the imparted energy in the present invention.

Figure 11:
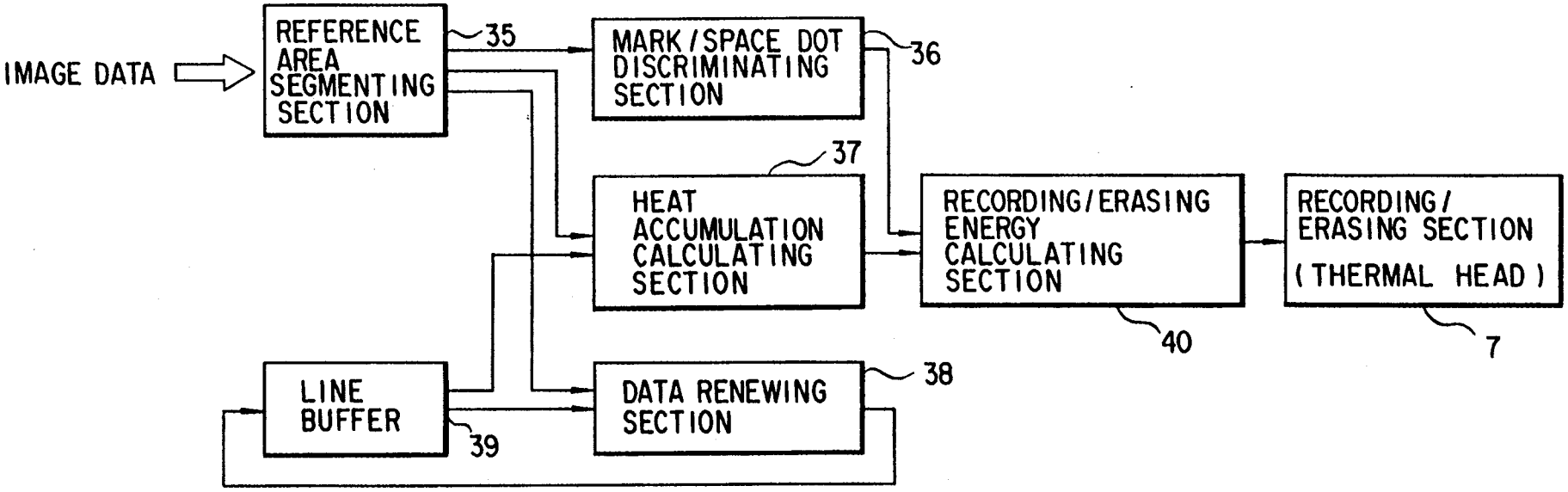
FIG. 11 shows a block diagram explaining an applying energy control section.

FIG. 11 is a schematic block diagram of a circuit for compensating heat energy to be imparted to the thermal head 7. This circuit is included in the thermal head control circuit 27 of FIG. 4.

Data transferred through the CPU 21, that is, image data to be recorded is serially inputted to a reference area segmenting section 35 in units of one line data. The reference area segmenting section 35 segments a portion corresponding to the reference area in the vicinity of the objective pixel in line data, and segmented data is outputted to a mark/space dot discriminating section 36, a heat accumulation calculating section 37, and a data renewing section 38. The mark/space dot discriminating section 36 discriminates whether the objective pixel is the mark dot which forms the image, or the space dot which does not form the image.

A line buffer 39 has a capacity of the number of lines corresponding to the reference area, and the data renewing section 38 sequentially renews image data of the line buffer 39. Image data corresponding to the reference area is inputted to the heat accumulation calculating section 37 from the reference area segmenting section 35 and the line buffer 39. Then, the amount of heat accumulation to the objective pixel is calculated by use of a weighting table 41, which is set in advance as shown in FIG. 12A. A recording/erasing energy calculating section 40 compensates for the output from the mark/space dot discriminating section 36 based on the output sent from the heat accumulation calculating section 37, and calculates the amount of optimum energy imparted to the objective pixel. Data showing the corrected amount of optimum energy imparted is sent to thee recording/erasing section, that is, the thermal head 7, and the recording of the visible image and the erasing thereof are performed.

The feature of the above-mentioned printing system lies in the point that not only the heating element corresponding to the mark dot which forms the image, but also the heating element corresponding to the space dot which does not form the image, is heated. Due to this, the weighting table for mark dot and the weighting table for space dot are provided in the heat accumulation calculating section 37.

The following will explain how to obtain the amount of heat accumulation to the objective pixel by use of a weighting table 41 in the heat accumulation calculating section 37.

Figure 12B:
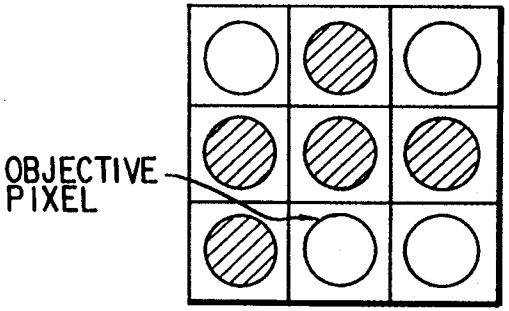
FIGS. 12A and 12B are views explaining the calculation of an amount of heat accumulation using a weighting table.
Figure 12A:
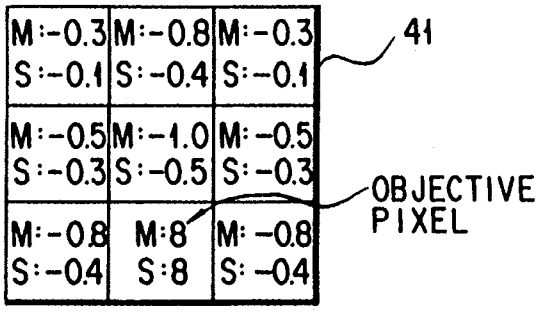

FIG. 12A shows an example of weighting values in the weighting table of a reference area, and FIG. 12B shows an example of pixels corresponding to the weighting table. In this embodiment, the weighting table having the size of 3 dots×3 dots is used. For example, regarding weighting values which show M: −0.3, S: −0.1, if pixel corresponding to the position of the weighting values is the mark dot forming the image, the weighting value is "−0.3" and if space dot, the weighting value is "−0.1". The larger the negative value of the weighting value is, the larger the amount of heat accumulation at the position showing the value becomes. In other words, a pixel corresponding to larger negative value of weighting value has a great influence on the objective pixel. By adding the weighting values for all the pixels in the reference area, the amount of heat 10 accumulation in the vicinity of the objective pixel can be calculated property.

In the example of FIG. 12A, the weighting values corresponding to the objective pixel are M:8, S:8. These values correspond to the basic heating time of the mark dot and that of the space dot. The value, which is obtained by adding the weight of each element to these values, becomes heating time for the objective pixel.

By compensating the number of driving pulses for the different heat accumulating energy in each heating element of the thermal head, the temperature of the recording layer of the recording medium can be set to the cloud temperature range in the case of the mark dot, and to the transparency temperature range in the case of the space dot regardless of the surrounding dots.

In the case of the above correction, since the same number of driving pulses is used at the time of recording and erasing as shown in FIGS. 6 and 7, the driving pulses can be controlled in the same accuracy at the time of recording and erasing. In other words, referring to FIGS. 6 and 7, seven to eight temperature peaks are generated in each state transition temperature range at the time of both recording and erasing. Therefore, the correction can be performed to the same extent of the number of pulses (recording: 7 pulses, erasing: 8 pulses).

In the case of the conventional system which performs the recording and erasing operations based on a driving pulse train formed of a plurality of pulses, where the duty factors of the driving pulses for the recording and erasing are set to be the same, and the number of pulses is changed, to perform the recording and erasing. The recording medium, in the case of the erasing, must be heated by smaller number of pulses than the case of recording. Due to this, the correction can not be performed with the same accuracy since the number of pulses which can be used for correction in the desired temperature range, in the case of the erasing is smaller than the case of the recording.

According to the above-explained embodiment, the visible image can be rewritten without erasing all of the already-recorded visible image in advance. Moreover, since the same number of the driving pulse trains can be used at the time of recording and erasing, the correction for heat accumulation can be controlled in the same level of accuracy, so that control can be easily performed and much clear visible image recording can be performed.

Furthermore, the visible image can be recorded and erased by the same means, that is, one thermal head, so that the miniaturization of the apparatus and the simplification of the apparatus can be realized. Also, the erasing as well as recording can be performed in an arbitrary portion of the recording medium by the pixel unit.

In the above-explained embodiment, the cloudy state of the recording layer of the recording medium was used as a recording image. However, it is possible to set the cloudy state as an initial state and to use the transparent state as a recording image. Moreover, the recording material for the recording medium to which the present invention can be applied is not limited to the material used in the above-described embodiments. For example, the present invention can be applied to the recording medium using a recording material using leuco dye, which can apply a reversible tone change by only the control of the thermal energy, as a coloring source.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A thermal recording apparatus for recording and erasing an image on and from a recording medium, where the image is recorded on the recording medium when heated to a first temperature and where the image is erased from the recording medium when heated to a second temperature, the second temperature being lower than the first temperature, the apparatus comprising:

thermal recording means having a heating element for heating the recording medium;

means for generating a pulse signal sequentially having a first period, a second period and a third period to energize said thermal recording means in a pixel recording period, said first period being longer than said second period and said second period being longer than said third period;

means, responsive to said pulse signal generating means, for outputting a recording pulse signal when recording the image and for outputting an erasing pulse signal when erasing the image, said recording pulse signal having a period corresponding to said first period and said second period, and the erasing pulse signal having a period corresponding to said first period and said third period; and driving means for driving said thermal recording means to heat said heating element in accordance with the recording pulse signal and the erasing pulse signal outputted by said outputting means.

2. A printing system for forming a visible image using dots and a recording medium which shows first and second states depending on a heating process, said system comprising:

thermal recording means having a plurality of heating elements, each heating element recording one of said dots on said recording medium in one of said first and second states;

first means for electrically energizing each of said heating elements using a first driving pulse train having a plurality of pulses of a first duty factor in one dot formation period, said first driving pulse train being used to record one of said dots in said first state forming said visible image on said recording medium; and second means for electrically energizing each of said heating elements using a second driving pulse train including pulses of a second duty factor which is different from said first duty factor, a difference in a number of pulses between said first driving pulse train and said second driving pulse train being equal to or smaller than one in order to record one of said dots in said second state on said recording medium.

3. The system according to claim 2, wherein said first and second driving pulse trains having a pulse, serving as a first pulse which has a larger width than that of said pulses of said first duty factor and said pulses of said second duty factor.

4. A printing system for recording and erasing a visible image on/from a recording medium having a recording layer being changed to be non-transparent when heated to a first temperature range and to be transparent when heated to a second temperature range, said recording medium being heated using a thermal head having a plurality of heating members, said printing system comprising:

means for generating a first pulse train having a plurality of pulses of a first duty factor in one dot formation period in order to record each non-transparent dot forming said visible image on said recording medium;

means for electrically energizing said heating members using said first pulse train to heat said medium, contacted with said heating members, at said first temperature range;

means for generating a second pulse train including pulses of a second duty factor which is smaller than said first duty factor, a difference in a number of pulses between said first pulse train and said second pulse train being equal to or smaller than one in order to record each transparent space dot on said recording medium; and means for electrically energizing said heating members using said second pulse train to heat said medium, contacted with said heating members at said second temperature range.

5. The system according to claim 4, wherein said first pulse train generating means and said second pulse train generating means respectively have means for generating a pulse, serving as a first pulse having a larger width than that of said pulses of said first duty factor and said pulses of said second duty factor, and said heating members being electrically energized during said first pulse, so that said recording medium is heated at said second temperature range.

6. The system according to claim 5, wherein a time distance from a fall of said first pulse to a rise of a first pulse among said pulses of said first duty factor of said first pulse train is shorter than a time distance from said fall of said first pulse to a rise of a first pulse among said pulses of said second duty factor of said second pulse train.

7. A printing method for recording and erasing a visible image on/from a recording medium having a recording layer being changed to be non-transparent when heated to a first temperature range and to be transparent when heated to a second temperature range by use of a thermal head having a plurality of heating elements, said method comprising the steps of:

generating a first pulse train having a plurality of pulses of a first duty factor in one dot formation period in order to record each non-transparent dot forming said visible image on said recording medium;

electrically energizing said heating elements using said first pulse train to heat said medium, contacted with said heating elements, at said first temperature range;

generating a second pulse train including pulses of a second duty factor smaller than said first duty factor, a difference in a number of pulses between said first pulse train and said second pulse train being equal to or smaller than one in order to record each transparent space dot on said recording medium; and electrically energizing said heating elements using said second pulse train to heat said medium, contacted with said heating elements, at said second temperature range.

8. The method according to claim 7, wherein said steps of generating said first and said second pulse trains respectively include a step of generating a pulse, serving as a first pulse, having a larger width than that of said pulses having said first duty factor and said pulses having second duty factor, and said heating elements being electrically energized during said first pulse, so that said recording medium is heated at said second temperature range.

9. The method according to claim 8, wherein a time distance from a fall of said first pulse to a rise of a first pulse among said pulses of said first duty factor of said first pulse train, is shorter than a time distance from said fall of said first pulse train to a rise of a first pulse among said pulses of said second duty factor of said second pulse.

* * * * *